US011238817B2

(12) United States Patent
Kang

(10) Patent No.: US 11,238,817 B2
(45) Date of Patent: Feb. 1, 2022

(54) METHOD AND APPARATUS FOR PIXEL SIGNAL CONVERSION

(71) Applicant: HKC Corporation Limited, Shenzhen (CN)

(72) Inventor: Chih Tsung Kang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/043,305

(22) PCT Filed: Nov. 19, 2018

(86) PCT No.: PCT/CN2018/116231

§ 371 (c)(1),
(2) Date: Sep. 29, 2020

(87) PCT Pub. No.: WO2020/093443

PCT Pub. Date: May 14, 2020

(65) Prior Publication Data

US 2021/0256922 A1 Aug. 19, 2021

(30) Foreign Application Priority Data

Nov. 7, 2018 (CN) ..... 201811320170.2

(51) Int. Cl.
*G09G 3/36* (2006.01)

(52) U.S. Cl.
CPC ... *G09G 3/3607* (2013.01); *G09G 2300/0452* (2013.01); *G09G 2320/0242* (2013.01); *G09G 2340/06* (2013.01)

(58) Field of Classification Search
CPC ..... G09G 3/3607; G09G 2340/06; G09G 2300/0452; G09G 2320/0242
See application file for complete search history.

(56) References Cited

U.S. PATENT DOCUMENTS

2014/0111409 A1* 4/2014 Kasegawa ..... G09G 5/02 345/84
2016/0253942 A1* 9/2016 Tseng ..... G09G 3/2003 345/601

(Continued)

FOREIGN PATENT DOCUMENTS

CN 101350171 A 1/2009
CN 101625476 A 1/2010

(Continued)

OTHER PUBLICATIONS

International Search Report from International Application No. PCT/CN2018/116231 dated Jul. 25, 2019.

*Primary Examiner* — Carolyn R Edwards
(74) *Attorney, Agent, or Firm* — Dorsey & Whitney LLP

(57) ABSTRACT

A method and an apparatus for pixel signal conversion are provided. The method includes: based on an initial first subpixel signal, an initial second subpixel signal, and an initial third subpixel signal of a pixel signal, obtaining a corresponding first stimulus value signal, second stimulus value signal, and third stimulus value signal. When converted pixel signals are applied to a hybrid-color display consisting of subpixels of four colors of W, R, G, and B, a display effect is closer to actual representation of original hybrid colors of R, G, and B, to alleviate a color shift defect of a large view angle.

15 Claims, 5 Drawing Sheets

(56) References Cited

U.S. PATENT DOCUMENTS

| | | | | |
|---|---|---|---|---|
| 2017/0004755 | A1* | 1/2017 | He | G09G 3/3208 |
| 2020/0143732 | A1* | 5/2020 | Xi | G09G 3/2003 |

FOREIGN PATENT DOCUMENTS

| | | | |
|---|---|---|---|
| CN | 102394040 | A | 3/2012 |
| CN | 103295559 | A | 9/2013 |
| CN | 103714771 | A | 4/2014 |
| CN | 104077997 | A | 10/2014 |
| CN | 104269138 | A | 1/2015 |
| CN | 104471922 | A | 3/2015 |
| CN | 104952423 | A | 9/2015 |
| CN | 104981861 | A | 10/2015 |
| CN | 105472364 | A | 4/2016 |
| CN | 107945729 | A | 4/2018 |
| JP | 5122268 | B2 | 11/2012 |
| KR | 20180063611 | A | 6/2018 |

* cited by examiner

METHOD AND APPARATUS FOR PIXEL SIGNAL CONVERSION

CROSS REFERENCE TO RELATED APPLICATIONS

This application claims priority to Chinese Patent Application No. 2018113201702, entitled "METHOD AND APPARATUS FOR PIXEL SIGNAL CONVERSION" and filed with the Chinese Patent Office on Nov. 7, 2018, the entire content of which is incorporated herein in its entirety.

TECHNICAL FIELD

The present application relates to a method and an apparatus for pixel signal conversion.

BACKGROUND

In a conventional liquid crystal display, a required display color is generally generated by a hybrid color of a three-color light source that is generated by three subpixels of red (R), green (G), and blue (B). The three subpixels R, G, and B absorb a photoresist, to absorb an optical band not belonging to subpixel units R, G, B, so that the three subpixels R, G, and B generate a corresponding light source of three colors R, G, and B.

Because of the increase of a resolution of a liquid crystal display, an increase of the subpixel, combined with a decrease of a pixel aperture ratio corresponding to the subpixel, a transmittance of a high-resolution display is lost and an optical efficiency is decreased. Therefore, to balance a high resolution, a transmittance, an optical efficiency, and a cost of a backlight architecture of a liquid crystal display, a hybrid-color display formed by four color subpixels W, R, G, and B appears. The subpixel W has no photoresist absorbing material absorbing energies of visible lights, so that a transmittance and an optical efficiency of the display can be improved.

However, because the subpixel W has a high transmittance, color shift is caused by light leakage of a large view angle, and consequently picture quality is affected when an image is watched at a large view angle. In addition, because full-wavelength transmittance properties of a visible light of a front view angle and a large view angle of some types of liquid crystal displays are different, an optical property of watching the liquid crystal displays at a large view angle cannot maintain a same correct color displayed when the liquid crystal displays are watched at a front view angle.

Therefore, the inventor finds that when a subpixel signal of three colors R, G, and B is used for driving a hybrid-color display formed by four-color subpixels W, R, G, and B, there is a defect of color shift of a large view angle.

SUMMARY

Based on various embodiments disclosed in the present application, a method and an apparatus for pixel signal conversion are provided.

A method for pixel signal conversion includes the following steps:

obtaining a pixel signal, wherein the pixel signal includes an initial first subpixel signal, an initial second subpixel signal, and an initial third subpixel signal, and the pixel signal is configured to correspondingly drive a subpixel R, a subpixel G, and a subpixel B in a specific pixel unit;

obtaining first stimulus value signals of the initial first subpixel signal based on the initial first subpixel signal, obtaining second stimulus value signals of the initial second subpixel signal based on the initial second subpixel signal, and obtaining third stimulus value signals of the initial third subpixel signal based on the initial third subpixel signal;

obtaining a fourth subpixel signal based on a minimum value in a set stimulus value signals, wherein the set of stimulus value signals includes a first stimulus value signal, a second stimulus value signal, and a third stimulus value signal; and using the initial first subpixel signal, the initial second subpixel signal, the initial third subpixel signal, and the fourth subpixel signal as converted pixel signals, wherein the converted pixel signals are configured to correspondingly drive the subpixel R, the subpixel G, the subpixel B, and a subpixel W in the specific pixel unit.

In an embodiment, a process of obtaining a fourth subpixel signal based on a minimum value in a set of stimulus value signalst includes the following step:

assigning any fourth stimulus value signal to the minimum value, based on a relationship between the fourth subpixel signal and the any fourth stimulus value signal of the fourth subpixel signal, to obtain the fourth subpixel signal.

In an embodiment, the fourth stimulus value signal is a stimulus value signal WX, a stimulus value signal WY, or a stimulus value signal WZ; and the any fourth stimulus value signal is the stimulus value signal WY.

In an embodiment, the first stimulus value signal is a stimulus value signal RX, a stimulus value signal RY, or a stimulus value signal RZ;

the second stimulus value signal is a stimulus value signal GX, a stimulus value signal GY, or a stimulus value signal GZ; and the third stimulus value signal is a stimulus value signal BX, a stimulus value signal BY, or a stimulus value signal BZ.

In an embodiment, the set of stimulus value signals includes the stimulus value signal RY, the stimulus value signal GY, and the stimulus value signal BY.

In an embodiment, the set of stimulus value signals includes the stimulus value signal RX, the stimulus value signal GY, and the stimulus value signal BZ.

In an embodiment, a process of obtaining first stimulus value signals of the initial first subpixel signal based on the initial first subpixel signal is represented by a following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

a process of obtaining second stimulus value signals of the initial second subpixel signal based on the initial second subpixel signal is represented by a following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and a process of obtaining third stimulus value signals of the initial third subpixel signal based on the initial third subpixel signal is represented by a following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases},$$

wherein

RX is the stimulus value signal RX, RY is the stimulus value signal RY, RZ is the stimulus value signal RZ, and R is the initial first subpixel signal; GX is the stimulus value signal GX, GY is the stimulus value signal GY, GZ is the stimulus value signal GZ, and G is the initial second subpixel signal; BX is the stimulus value signal BX, BY is the stimulus value signal BY, BZ is the stimulus value signal BZ, and B is the initial third subpixel signal; and T is a maximum pixel signal value; and γRX, γRY, and γRZ are all stimulus value power functions of the initial first subpixel signal; γGX, γGY, and γGZ are all stimulus value power functions of the initial second subpixel signal; and γBX, γBY, and γBZ are all stimulus value power functions of the initial third subpixel signal.

An apparatus for pixel signal conversion includes:

a pixel signal obtaining module, configured to obtain a pixel signal, wherein the pixel signal includes an initial first subpixel signal, an initial second subpixel signal, and an initial third subpixel signal, and the pixel signal is configured to correspondingly drive a subpixel R, a subpixel G, and a subpixel B in a specific pixel unit;

a signal processing module, configured to obtain first stimulus value signals of the initial first subpixel signal based on the initial first subpixel signal, obtain second stimulus value signals of the initial second subpixel signal based on the initial second subpixel signal, and obtain third stimulus value signals of the initial third subpixel signal based on the initial third subpixel signal;

a subpixel W obtaining module, configured to obtain a fourth subpixel signal based on a minimum value in a set of stimulus value signals, wherein the set of stimulus value signals includes a first stimulus value signal, a second stimulus value signal, and a third stimulus value signal; and a signal conversion module, configured to use the initial first subpixel signal, the initial second subpixel signal, the initial third subpixel signal, and the fourth subpixel signal as converted pixel signals, wherein the converted pixel signals are configured to correspondingly drive the subpixel R, the subpixel G, the subpixel B, and a subpixel W in the specific pixel unit.

In an embodiment, a process of obtaining a fourth subpixel signal based on a minimum value in a set of stimulus value signal includes the following step: assigning any fourth stimulus value signal to the minimum value, based on a relationship between the fourth subpixel signal and the any fourth stimulus value signal of the fourth subpixel signal, to obtain the fourth subpixel signal.

In an embodiment, the fourth stimulus value signal is a stimulus value signal WX, a stimulus value signal WY, or a stimulus value signal WZ; and the any fourth stimulus value signal is the stimulus value signal WY.

In an embodiment, the first stimulus value signal is a stimulus value signal RX, a stimulus value signal RY, or a stimulus value signal RZ;

the second stimulus value signal is a stimulus value signal GX, a stimulus value signal GY, or a stimulus value signal GZ; and the third stimulus value signal is a stimulus value signal BX, a stimulus value signal BY, or a stimulus value signal BZ.

In an embodiment, the set of stimulus value signals includes the stimulus value signal RY, the stimulus value signal GY, and the stimulus value signal BY.

In an embodiment, the set of stimulus value signals includes the stimulus value signal RX, the stimulus value signal GY, and the stimulus value signal BZ.

In an embodiment, a process of obtaining first stimulus value signals of the initial first subpixel signal based on the initial first subpixel signal is represented by a following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

a process of obtaining second stimulus value signals of the initial second subpixel signal based on the initial second subpixel signal is represented by a following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and a process of obtaining third stimulus value signals of the initial third subpixel signal based on the initial third subpixel signal is represented by a following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases},$$

wherein

RX is the stimulus value signal RX, RY is the stimulus value signal RY, RZ is the stimulus value signal RZ, and R is the initial first subpixel signal; GX is the stimulus value signal GX, GY is the stimulus value signal GY, GZ is the stimulus value signal GZ, and G is the initial second subpixel signal; BX is the stimulus value signal BX, BY is the stimulus value signal BY, BZ is the stimulus value signal BZ, and B is the initial third subpixel signal; and T is a maximum pixel signal value; and γRX, γRY, and γRZ are all stimulus value power functions of the initial first subpixel signal; γGX, γGY, and γGZ are all stimulus value power functions of the initial second subpixel signal; and γBX, γBY, and γBZ are all stimulus value power functions of the initial third subpixel signal.

A computer device includes a memory and a processor. The memory stores a computer program, and when executing the computer program, the processor performs the following steps:

obtaining a pixel signal, wherein the pixel signal includes an initial first subpixel signal, an initial second subpixel signal, and an initial third subpixel signal, and the pixel signal is configured to correspondingly drive a subpixel R, a subpixel G, and a subpixel B in a specific pixel unit;

obtaining first stimulus value signals of the initial first subpixel signal based on the initial first subpixel signal, obtaining second stimulus value signals of the initial second subpixel signal based on the initial second subpixel signal, and obtaining third stimulus value signals of the initial third subpixel signal based on the initial third subpixel signal;

obtaining a fourth subpixel signal based on a minimum value in a set of stimulus value signals, wherein the set of stimulus value signals includes a first stimulus value signal, a second stimulus value signal, and a third stimulus value signal; and using the initial first subpixel signal, the initial second subpixel signal, the initial third subpixel signal, and the fourth subpixel signal as converted pixel signals, wherein the converted pixel signals are configured to correspondingly drive the subpixel R, the subpixel G, the subpixel B, and a subpixel W in the specific pixel unit.

In an embodiment, a process of obtaining a fourth subpixel signal based on a minimum value in a set of stimulus value signal includes the following step:

assigning any fourth stimulus value signal to the minimum value, based on a relationship between the fourth subpixel signal and the any fourth stimulus value signal of the fourth subpixel signal, to obtain the fourth subpixel signal.

In an embodiment, the fourth stimulus value signal is a stimulus value signal WX, a stimulus value signal WY, or a stimulus value signal WZ; and the any fourth stimulus value signal is the stimulus value signal WY.

In an embodiment, the first stimulus value signal is a stimulus value signal RX, a stimulus value signal RY, or a stimulus value signal RZ;

the second stimulus value signal is a stimulus value signal GX, a stimulus value signal GY, or a stimulus value signal GZ; and the third stimulus value signal is a stimulus value signal BX, a stimulus value signal BY, or a stimulus value signal BZ.

In an embodiment, the set of stimulus value signals includes the stimulus value signal RY, the stimulus value signal GY, and the stimulus value signal BY.

Details of one or more embodiments of the present application are provided in the following accompanying drawings and descriptions. Other features and advantages of the present application become apparent in the specification, the accompanying drawings, and the claims.

BRIEF DESCRIPTION OF THE DRAWINGS

To illustrate the technical solutions according to the embodiments of the present application more clearly, the accompanying drawings required for describing the embodiments are introduced briefly below. Apparently, the accompanying drawings in the following description are only some embodiments of the present application, and a person of ordinary skill in the art can derive other drawings from the accompanying drawings without creative efforts.

DETAILED DESCRIPTION OF THE EMBODIMENTS

The present application will be further described in detail below with reference to the accompanying drawings and embodiments, so that the technical solutions and advantages of the present application will become clearer. It should be understood that the specific embodiments described herein are merely used to illustrate the present application but not intended to limit the present application.

A method for pixel signal conversion is provided according to the present application.

Figure 1:
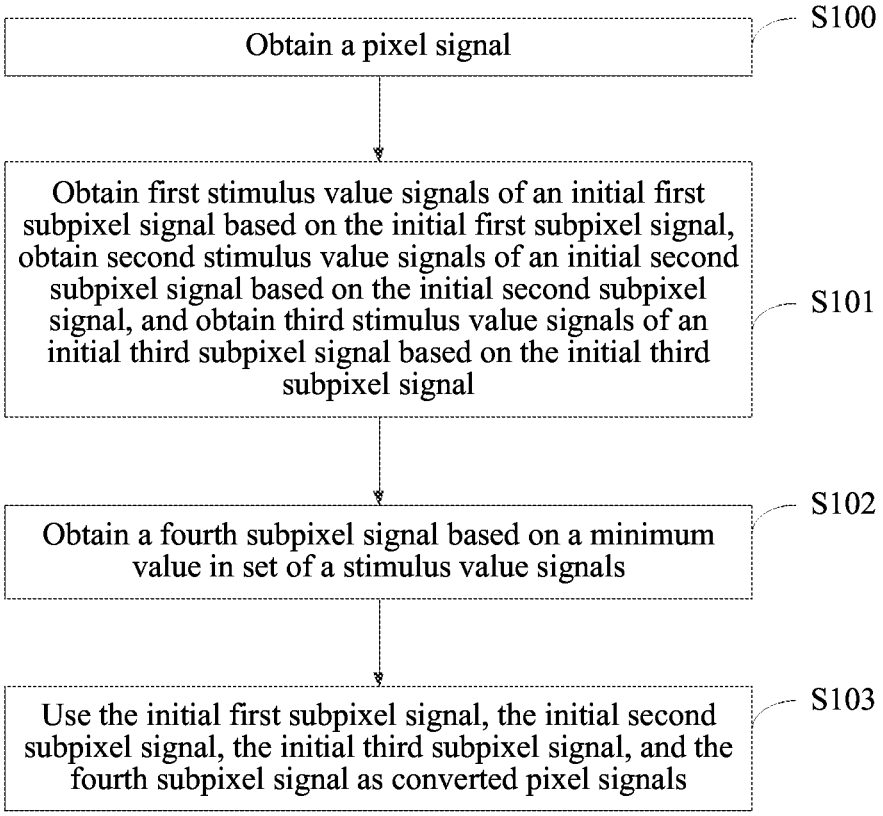
FIG. 1 is a schematic flowchart of a method for pixel signal conversion according to one or more embodiments.

FIG. 1 is a schematic flowchart of a method for pixel signal conversion according to an implementation. As shown in FIG. 1, the method for pixel signal conversion includes steps S100 to S103.

S100: Obtain a pixel signal, where the pixel signal includes an initial first subpixel signal, an initial second subpixel signal, and an initial third subpixel signal. In an embodiment, the pixel signal is configured to correspondingly drive a subpixel R, a subpixel G, and a subpixel B in a specific pixel unit.

In an embodiment, the first subpixel signal may be a subpixel R signal, the second subpixel signal may be a subpixel G signal, the third subpixel signal may be a subpixel B signal, and the fourth subpixel may be a subpixel W signal.

Figure 2:
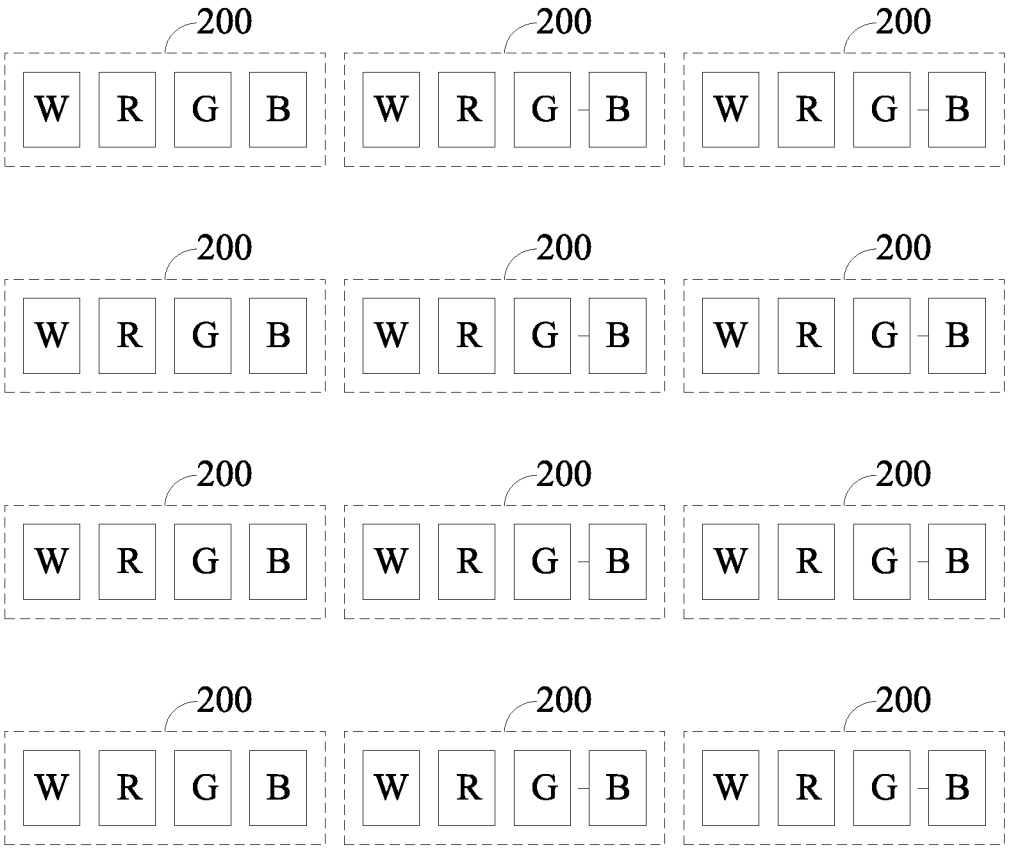
FIG. 2 is a schematic diagram of a four-color display array.

In an embodiment, FIG. 2 is a schematic diagram of a four-color display array. As shown in FIG. 2, the four-color display array includes a plurality of four-color pixel units 200 arranged in rows and columns. Each four-color pixel unit 200 includes four subpixels, that is, a subpixel R, a subpixel G, a subpixel B, and a subpixel W (white). A conventional three-color display array includes a plurality of three-color pixel units arranged in rows and columns. Each three-color pixel unit includes only three subpixels, that is, the subpixel R, the subpixel G, and the subpixel B. In an embodiment, the specific pixel unit may be any pixel unit in the four-color display array shown in FIG. 2. The pixel signal before conversion obtained in step S100 is configured to correspondingly drive the subpixel R, the subpixel G, and the subpixel B in the specific pixel unit, to change brightness of the correspondingly driven subpixel. Specifically, the initial first subpixel signal drives the subpixel R, the initial second subpixel signal drives the subpixel G, and the initial third subpixel signal drives the subpixel B.

S101: Obtain first stimulus value signals of the initial first subpixel signal based on the initial first subpixel signal, obtain second stimulus value signals of the initial second subpixel signal based on the initial second subpixel signal, and obtain third stimulus value signals of the initial third subpixel signal based on the initial third subpixel signal.

The pixel signal includes three subpixel signals, that is, the initial first subpixel signal, the initial second subpixel signal, and the initial third subpixel signal. In an embodiment, each subpixel signal corresponds to a stimulus value signal based on optical brightness. It should be noted that a subpixel signal may correspond to a plurality of stimulus value signals. Specifically, a stimulus value signal corresponding to the initial first subpixel signal is the first stimulus value signal, a stimulus value signal corresponding to the initial second subpixel signal is the second stimulus value signal, and a stimulus value signal corresponding to the initial third subpixel signal is the third stimulus value signal.

In an embodiment, the first stimulus value signal is a stimulus value signal RX, a stimulus value signal RY, or a stimulus value signal RZ;

the second stimulus value signal is a stimulus value signal GX, a stimulus value signal GY, or a stimulus value signal GZ; and the third stimulus value signal is a stimulus value signal BX, a stimulus value signal BY, or a stimulus value signal BZ.

Correspondingly, a process of obtaining first stimulus value signals of the initial first subpixel signal based on the initial first subpixel signal is represented by a following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

a process of obtaining second stimulus value signals of the initial second subpixel signal based on the initial second subpixel signal is represented by a following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and a process of obtaining third stimulus value signals of the initial third subpixel signal based on the initial third subpixel signal is represented by a following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases}.$$

In an embodiment, RX is the stimulus value signal RX, RY is the stimulus value signal RY, RZ is the stimulus value signal RZ, and R is the initial first subpixel signal; GX is the stimulus value signal GX, GY is the stimulus value signal GY, GZ is the stimulus value signal GZ, and G is the initial second subpixel signal; BX is the stimulus value signal BX, BY is the stimulus value signal BY, BZ is the stimulus value signal BZ, and B is the initial third subpixel signal; and T is a maximum pixel signal value.

In an embodiment, the maximum pixel signal value depends on a type of a displayed image. For example, when an 8-bit greyscale image is displayed, the maximum pixel signal value is $2^8-1=255$.

In an embodiment, γRX, γRY, and γRZ are all stimulus value power functions of the initial first subpixel signal; γGX, γGY, and γGZ are all stimulus value power functions of the initial second subpixel signal; and γBX, γBY, and γBZ are all stimulus value power functions of the initial third subpixel signal.

S102: Obtain a fourth subpixel signal based on a minimum value in a set of stimulus value signal. In an embodiment, the set of stimulus value signal includes a first stimulus value signal, a second stimulus value signal, and a third stimulus value signal.

In an embodiment, the set of stimulus value signal includes the stimulus value signal RY, the stimulus value signal GY, and the stimulus value signal BY.

Figure 3:
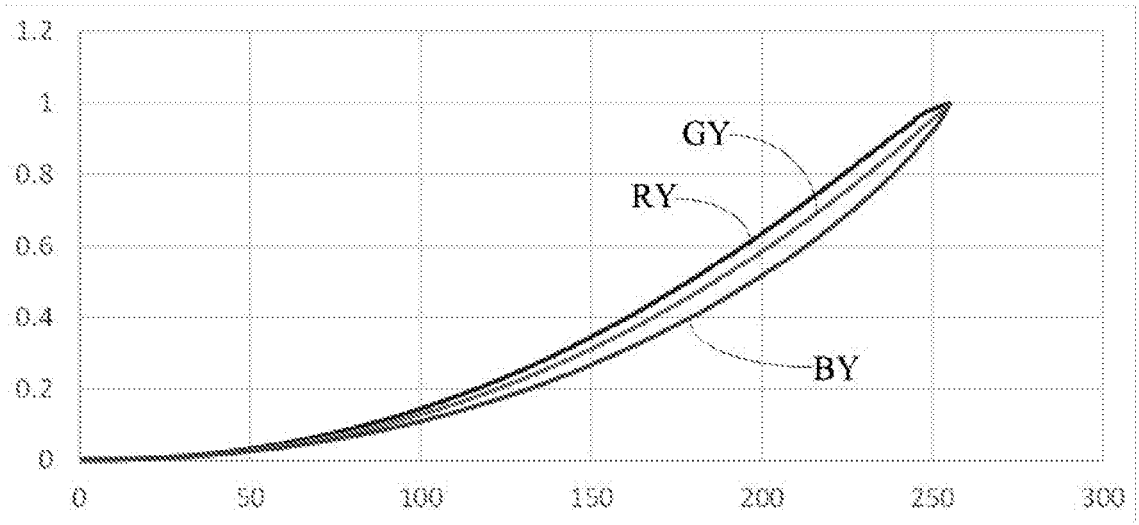
FIG. 3 is a schematic diagram of a curve of a set of stimulus value signals according to one or more embodiments.

The set of stimulus value signals is set as U1, U1=(RY, GY, BY). FIG. 3 is a schematic diagram of a curve of a set of stimulus value signals according to an implementation. As shown in FIG. 3, a horizontal direction shows a subpixel signal, and a vertical direction shows a stimulus value signal. Change of the stimulus value signal in the set of stimulus value signals along with the subpixel signal is represented in FIG. 3. In an embodiment, the minimum value in the set of stimulus value signals Min1=min(RY, GY, BY).

In an embodiment, the set of stimulus value signals includes the stimulus value signal RX, the stimulus value signal GY, and the stimulus value signal BZ.

Figure 4:
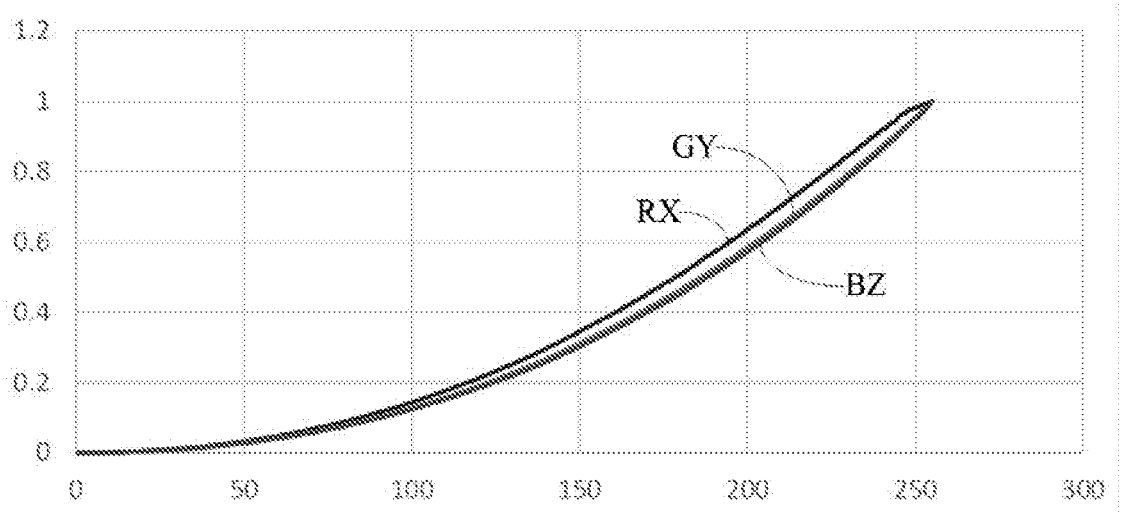
FIG. 4 is a schematic diagram of a curve of another set of stimulus value signals according to one or more embodiments.

The set of stimulus value signals is set as U2, U2=(RX, GY, BZ). FIG. 4 is a schematic diagram of a curve of a set of stimulus value signal according to another implementation. As shown in FIG. 4, a horizontal direction shows a subpixel signal, and a vertical direction shows a stimulus value signal. Change of the stimulus value signal in the set of stimulus value signals along with the subpixel signal is represented in FIG. 4. In an embodiment, as shown in FIG. 4, in comparison between the set of stimulus value signals U2 and the set of stimulus value signals U1, proportions and weights of the stimulus value signals in the set of stimulus value signals U2 are closer, so that a subsequently converted subpixel signal may be closer to actual representation of original R, G, B mixed-colors.

In an embodiment, the minimum value in the set of stimulus value signal Min2=min(RX, GY, BZ).

Figure 5:
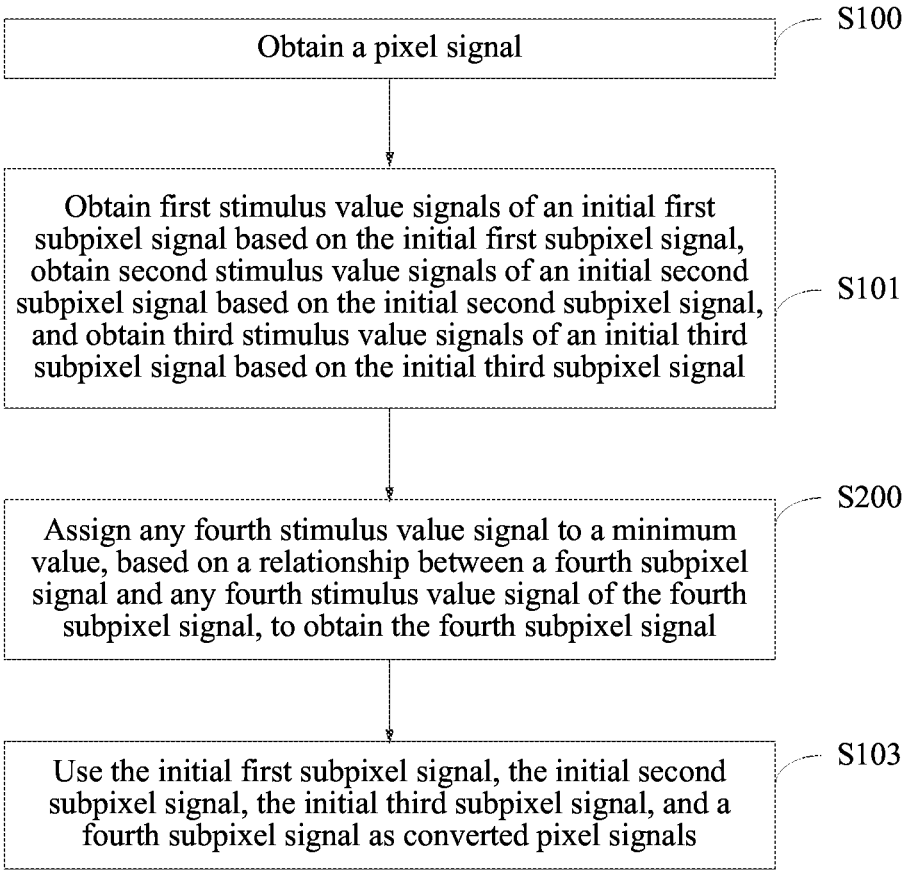
FIG. 5 is a flowchart of another method for pixel signal conversion according to one or more embodiments.

FIG. 5 is a flowchart of a method for pixel signal conversion according to another implementation. As shown in FIG. 5, a process of obtaining a fourth subpixel signal based on a minimum value in a set of stimulus value signals in step S102 includes step S200.

S200: Assign any fourth stimulus value signal to the minimum value, based on a relationship between the fourth subpixel signal and the any fourth stimulus value signal of the fourth subpixel signal, to obtain the fourth subpixel signal.

In an embodiment, correspondingly, the fourth subpixel signal also includes a stimulus value signal WX, a stimulus value signal WY, or a stimulus value signal WZ. In an embodiment, a relationship between the fourth subpixel signal and each stimulus value signal corresponding to the fourth subpixel signal is shown in a following formula:

$$\begin{cases} WX = (W/T)^{\wedge\gamma WX} \\ WY = (W/T)^{\wedge\gamma WY} \\ WZ = (W/T)^{\wedge\gamma WZ} \end{cases}.$$

In an embodiment, WX is the stimulus value signal WX, WY is the stimulus value signal WY, WZ is the stimulus value signal WZ, W is the fourth subpixel signal, and T is the maximum pixel signal value. γWX, γWY, and γWZ are all stimulus value power functions of the fourth subpixel signal.

Correspondingly, after the stimulus value signal of the fourth subpixel signal is determined, the fourth subpixel signal is obtained by using a following formula:

$$\begin{cases} W = WX^{\wedge(1/\gamma WX)} * 255 \\ W = WY^{\wedge(1/\gamma WX)} * 255. \\ W = WZ^{\wedge(1/\gamma WX)} * 255 \end{cases}$$

In an embodiment, WX is the stimulus value signal WX, WY is the stimulus value signal WY, WZ is the stimulus value signal WZ, W is the fourth subpixel signal, and T is the maximum pixel signal value. γWX, γWY, and γWZ are all stimulus value power functions of the fourth subpixel signal.

In an embodiment, the any fourth stimulus value signal is the stimulus value signal WY.

S103: Use the initial first subpixel signal, the initial second subpixel signal, the initial third subpixel signal, and the fourth subpixel signal as converted pixel signals. In an embodiment, the converted pixel signals are configured to correspondingly drive the subpixel R, the subpixel G, the subpixel B, and a subpixel W in the specific pixel unit.

In an embodiment, the converted pixel signals include the initial first subpixel signal, the initial second subpixel signal, the initial third subpixel signal, and the fourth subpixel signal. Correspondingly, as shown in FIG. 2, the initial first subpixel signal drives the subpixel R, the initial second subpixel signal drives the subpixel G, the initial third subpixel signal drives the subpixel B, and the fourth subpixel signal drives the subpixel W.

In the method for pixel signal conversion described above, based on the initial first subpixel signal, the initial second subpixel signal, and the initial third subpixel signal of the pixel signal, the corresponding first stimulus value signal, second stimulus value signal, and third stimulus value signal are obtained. Further, the fourth subpixel signal is obtained by using the minimum value in the set of stimulus value signals including the first stimulus value signal, the second stimulus value signal, and the third stimulus value signal. Finally, the initial first subpixel signal, the initial second subpixel signal, the initial third subpixel signal, and the fourth subpixel signal are used as the converted pixel signals. On this basis, when the converted pixel signals are applied to a hybrid-color display including subpixels of four colors of W, R, G, and B, a display effect is closer to actual representation of an original hybrid color of R, G, and B, to alleviate a color shift defect of a large view angle and improve a display effect.

An apparatus for pixel signal conversion is provided according to the present application.

Figure 6:
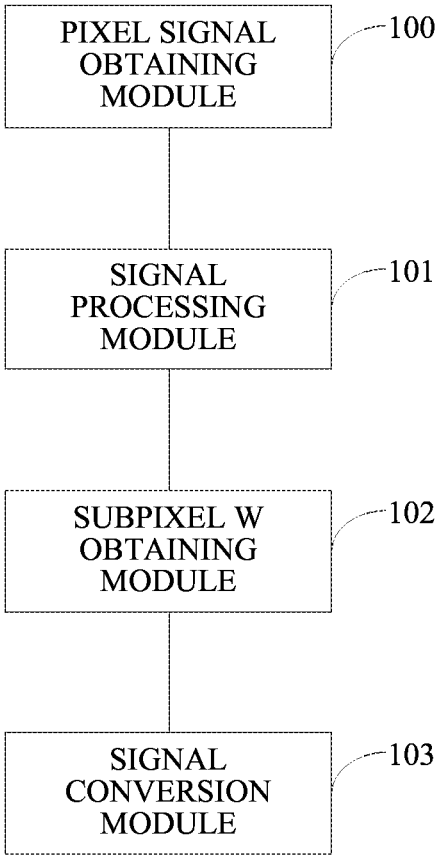
FIG. 6 is a modular structure diagram of modules of an apparatus for pixel signal conversion.

FIG. 6 is a modular structure diagram of an apparatus for pixel signal conversion. As shown in FIG. 6, the apparatus for pixel signal conversion includes modules 100 to 103.

A pixel signal obtaining module 100 is configured to obtain a pixel signal. The pixel signal includes an initial first subpixel signal, an initial second subpixel signal, and an initial third subpixel signal. In an embodiment, the pixel signal is used to correspondingly drive a subpixel R, a subpixel G, and a subpixel B in a specific pixel unit.

A signal processing module 101 is configured to obtain first stimulus value signals of the initial first subpixel signal based on the initial first subpixel signal, obtain second stimulus value signals of the initial second subpixel signal based on the initial second subpixel signal, and obtain third stimulus value signals of the initial third subpixel signal based on the initial third subpixel signal.

A subpixel W obtaining module 102 is configured to obtain a fourth subpixel signal based on a minimum value in a set of stimulus value signals. In an embodiment, the set of stimulus value signal includes a first stimulus value signal, a second stimulus value signal, and a third stimulus value signal.

In an embodiment, the subpixel W obtaining module 102 is configured to assign any fourth stimulus value signal to the minimum value, based on a relationship between the fourth subpixel signal and the any fourth stimulus value signal of the fourth subpixel signal.

A signal conversion module 103 is configured to use the initial first subpixel signal, the initial second subpixel signal, the initial third subpixel signal, and the fourth subpixel signal as converted pixel signals. In an embodiment, the converted pixel signals are used to correspondingly drive the subpixel R, the subpixel G, the subpixel B, and a subpixel W in the specific pixel unit.

In the apparatus for pixel signal conversion described above, based on the initial first subpixel signal, the initial second subpixel signal, and the initial third subpixel signal of the pixel signal, the corresponding first stimulus value signal, second stimulus value signal, and third stimulus value signal are obtained. Further, the fourth subpixel signal is obtained by using the minimum value in the set of stimulus value signals including the first stimulus value signal, the second stimulus value signal, and the third stimulus value signal. Finally, the initial first subpixel signal, the initial second subpixel signal, the initial third subpixel signal, and the fourth subpixel signal are used as the converted pixel signals. On this basis, when the converted pixel signals are applied to a hybrid-color display including subpixels of four colors of W, R, G, and B, a display effect is closer to actual representation of original hybrid colors of R, G, and B, to alleviate a color shift defect of a large view angle and improve a display effect.

In an embodiment, a computer device is provided. The computer device includes a memory and a processor. The memory stores a computer program, and when executing the computer program, the processor performs the following steps:

obtaining a pixel signal, where the pixel signal includes an initial first subpixel signal, an initial second subpixel signal, and an initial third subpixel signal, and in an embodiment, the pixel signal is configured to correspondingly drive a subpixel R, a subpixel G, and a subpixel B in a specific pixel unit;

obtaining first stimulus value signals of the initial first subpixel signal based on the initial first subpixel signal, obtaining second stimulus value signals of the initial second subpixel signal based on the initial second subpixel signal, and obtaining third stimulus value signals of the initial third subpixel signal based on the initial third subpixel signal; obtaining a fourth subpixel signal based on a minimum value in a set of stimulus value signals, where in an embodiment, the stimulus value signal set includes a first stimulus value signal, a second stimulus value signal, and a third stimulus value signal; and using the initial first subpixel signal, the initial second subpixel signal, the initial third subpixel signal, and the fourth subpixel signal as converted pixel signals, where in an embodiment, the converted pixel signals are configured to correspondingly drive the subpixel R, the subpixel G, the subpixel B, and a subpixel W in the specific pixel unit.

In the computer device described above, based on the initial first subpixel signal, the initial second subpixel signal, and the initial third subpixel signal of the pixel signal, the corresponding first stimulus value signal, second stimulus value signal, and third stimulus value signal are obtained. Further, the fourth subpixel signal is obtained by using the minimum value in the set of stimulus value signals including the first stimulus value signal, the second stimulus value signal, and the third stimulus value signal. Finally, the initial first subpixel signal, the initial second subpixel signal, the initial third subpixel signal, and the fourth subpixel signal are used as the converted pixel signals. On this basis, when the converted pixel signals are applied to a hybrid-color display including subpixels of four colors of W, R, G, and B, a display effect is closer to actual representation of original hybrid colors of R, G, and B, to alleviate a color shift defect of a large view angle and improve a display effect.

In an embodiment, a computer-readable storage medium is provided. The computer-readable storage medium stores a computer program. When the computer program is executed by a processor, the following steps are performed:

obtaining a pixel signal, where the pixel signal includes an initial first subpixel signal, an initial second subpixel signal, and an initial third subpixel signal, and in an embodiment, the pixel signal is configured to correspondingly drive a subpixel R, a subpixel G, and a subpixel B in a specific pixel unit;

obtaining first stimulus value signals of the initial first subpixel signal based on the initial first subpixel signal, obtaining second stimulus value signals of the initial second subpixel signal based on the initial second subpixel signal, and obtaining third stimulus value signals of the initial third subpixel signal based on the initial third subpixel signal;

obtaining a fourth subpixel signal based on a minimum value in a set of stimulus value signals, where in an embodiment, the set of stimulus value signals includes a first stimulus value signal, a second stimulus value signal, and a third stimulus value signal; and using the initial first subpixel signal, the initial second subpixel signal, the initial third subpixel signal, and the fourth subpixel signal as converted pixel signals, where in an embodiment, the converted pixel signals are configured to correspondingly drive the subpixel R, the subpixel G, the subpixel B, and a subpixel W in the specific pixel unit.

In the computer-readable storage medium, based on the initial first subpixel signal, the initial second subpixel signal, and the initial third subpixel signal of the pixel signal, the corresponding first stimulus value signal, second stimulus value signal, and third stimulus value signal are obtained. Further, the fourth subpixel signal is obtained by using the minimum value in the set of stimulus value signals including the first stimulus value signal, the second stimulus value signal, and the third stimulus value signal. Finally, the initial first subpixel signal, the initial second subpixel signal, the initial third subpixel signal, and the fourth subpixel signal are used as the converted pixel signals. On this basis, when the converted pixel signals are applied to a hybrid-color display including subpixels of four colors of W, R, G, and B, a display effect is closer to actual representation of original hybrid colors of R, G, and B, to alleviate a color shift defect of a large view angle and improve a display effect.

The technical features of the above-described embodiments may be combined arbitrarily. To simplify the description, not all possible combinations of the technical features in the above embodiments are described. However, all of the combinations of these technical features should be considered as within the scope of the present application, as long as such combinations do not contradict with each other.

The above embodiments merely illustrate several embodiments of the present application, and the description thereof is specific and detailed, but it shall not be constructed as limiting the scope of the present application. It should be noted that a number of variations and improvements may be made by persons of ordinary skill in the art without departing from the concept of the present application, which shall all fall into the protection scope of the present application. Therefore, the protection scope of the present application shall be subject to the appended claims.

What is claimed is:

1. A method for pixel signal conversion, the method comprising:

obtaining a pixel signal, wherein the pixel signal comprises an initial first subpixel signal, an initial second subpixel signal, and an initial third subpixel signal, and the pixel signal is configured to correspondingly drive a subpixel R, a subpixel G, and a subpixel B in a specific pixel unit;

obtaining first stimulus value signals of the initial first subpixel signal based on the initial $$\begin{cases} RX = (R/T)^{\wedge\gamma RX} \\ RY = (R/T)^{\wedge\gamma RY} \\ RZ = (R/T)^{\wedge\gamma RZ} \end{cases},$$

first subpixel signal by a first formula of wherein the first stimulus value signals are at least one of a stimulus value signal RX, a stimulus value signal RY, or a stimulus value signal RZ;

obtaining second stimulus value signals of the initial second subpixel signal based on the $$\begin{cases} GX = (G/T)^{\wedge\gamma GX} \\ GY = (G/T)^{\wedge\gamma GY} \\ GZ = (G/T)^{\wedge\gamma GZ} \end{cases},$$

initial second subpixel signal by a second formula of wherein the second stimulus value signals are at least one of a stimulus value signal GX, a stimulus value signal GY, or a stimulus value signal GZ;

□□ 가 가 stimulus value signals of the initial third subpixel signal based on the $$\begin{cases} BX = (B/T)^{\wedge\gamma BX} \\ BY = (B/T)^{\wedge\gamma BY} \\ BZ = (B/T)^{\wedge\gamma BZ} \end{cases},$$

initial third subpixel signal by a third formula of wherein the third stimulus value signals are at least one of a stimulus value signal BX, a stimulus value signal BY, or a stimulus value signal BZ;

obtaining a fourth subpixel signal based on a minimum value in a set of stimulus value signals, wherein the set of stimulus value signals comprises a first stimulus value signal of the first stimulus value signals, a second stimulus value signal of the second stimulus value signals, and a third stimulus value signal of the third stimulus value signals; and using the initial first subpixel signal, the initial second subpixel signal, the initial third subpixel signal, and the fourth subpixel signal as converted pixel signals, wherein the converted pixel signals are configured to correspondingly drive the subpixel R, the subpixel G, the subpixel B, and a subpixel W in the specific pixel unit, wherein:

RX is the stimulus value signal RX, RY is the stimulus value signal RY, RZ is the stimulus value signal RZ, and R is the initial first subpixel signal;

GX is the stimulus value signal GX, GY is the stimulus value signal GY, GZ is the stimulus value signal GZ, and G is the initial second subpixel signal;

BX is the stimulus value signal BX, BY is the stimulus value signal BY, BZ is the stimulus value signal BZ, and B is the initial third subpixel signal;

T is a maximum pixel signal value;

γRX, γRY, and γRZ are all stimulus value power functions of the initial first subpixel signal;

γGX, γGY, and γGZ are all stimulus value power functions of the initial second subpixel signal; and γBX, γBY and γBZ are all stimulus value power functions of the initial third subpixel signal.

2. The method for pixel signal conversion according to claim 1, wherein a process of obtaining a fourth subpixel signal based on a minimum value in a set of stimulus value signals comprises the following step:

assigning any fourth stimulus value signal to the minimum value, based on a relationship between the fourth subpixel signal and the any fourth stimulus value signal of the fourth subpixel signal, to obtain the fourth subpixel signal.

3. The method for pixel signal conversion according to claim 2, wherein the fourth stimulus value signal is a stimulus value signal WX, a stimulus value signal WY, or a stimulus value signal WZ; and the any fourth stimulus value signal is the stimulus value signal WY.

4. The method for pixel signal conversion according to claim 1, wherein the set of stimulus value signals comprises the stimulus value signal RY, the stimulus value signal GY, and the stimulus value signal BY.

5. The method for pixel signal conversion according to claim 1, wherein the set of stimulus value signals comprises the stimulus value signal RX, the stimulus value signal GY, and the stimulus value signal BZ.

6. A non-transitory computer-readable storage medium storing a computer program which, when executed by a processor, causes the processor to:

obtain a pixel signal, wherein the pixel signal comprises an initial first subpixel signal, an initial second subpixel signal, and an initial third subpixel signal, and the pixel signal is configured to correspondingly drive a subpixel R, a subpixel G, and a subpixel B in a specific pixel unit;

obtain first stimulus value signals of the initial first subpixel signal based on the initial first subpixel signal by a first formula of $$\begin{cases} RX = (R/T)^{\wedge\gamma RX} \\ RY = (R/T)^{\wedge\gamma RY} \\ RZ = (R/T)^{\wedge\gamma RZ} \end{cases},$$

wherein the first stimulus value signals are at least one of a stimulus value signal RX, a stimulus value signal RY, or a stimulus value signal RZ;

obtain second stimulus value signals of the initial second subpixel signal based on the $$\begin{cases} GX = (G/T)^{\wedge\gamma GX} \\ GY = (G/T)^{\wedge\gamma GY} \\ GZ = (G/T)^{\wedge\gamma GZ} \end{cases},$$

initial second subpixel signal by a second formula of wherein the second stimulus value signals are at least one of a stimulus value signal GX, a stimulus value signal GY, or a stimulus value signal GZ;

obtain third stimulus value signals of the initial third subpixel signal based on the initial $$\begin{cases} BX = (B/T)^{\wedge\gamma BX} \\ BY = (B/T)^{\wedge\gamma BY} \\ BZ = (B/T)^{\wedge\gamma BZ} \end{cases},$$

third subpixel signal by a third formula of wherein the third stimulus value signals are at least one of a stimulus value signal BX, a stimulus value signal BY, or a stimulus value signal BZ;

obtain a fourth subpixel signal based on a minimum value in a set of stimulus value signals, wherein the set of stimulus value signals comprises a first stimulus value signal of the first stimulus value signals, a second stimulus value signal of the second stimulus value signals, and a third stimulus value signal of the third stimulus value signals; and use the initial first subpixel signal, the initial second subpixel signal, the initial third subpixel signal, and the fourth subpixel signal as converted pixel signals, wherein the converted pixel signals are configured to correspondingly drive the subpixel R, the subpixel G, the subpixel B, and a subpixel W in the specific pixel unit, wherein:

RX is the stimulus value signal RX, RY is the stimulus value signal RY, RZ is the stimulus value signal RZ, and R is the initial first subpixel signal;

GX is the stimulus value signal GX, GY is the stimulus value signal GY, GZ is the stimulus value signal GZ, and G is the initial second subpixel signal;

BX is the stimulus value signal BX, BY is the stimulus value signal BY, BZ is the stimulus value signal BZ, and B is the initial third subpixel signal;

T is a maximum pixel signal value;

γRX, γRY, and γRZ are all stimulus value power functions of the initial first subpixel signal;

γGX, γGY, and γGZ are all stimulus value power functions of the initial second subpixel signal; and γBX, γBY and γBZ are all stimulus value power functions of the initial third subpixel signal.

7. The apparatus for pixel signal conversion non-transitory computer-readable storage medium according to claim 6, wherein computer program which, when executed by the processor, causes the processor to obtain a fourth subpixel signal based on a minimum value in a set of stimulus value signals causes the processor to:

assign any fourth stimulus value signal to the minimum value, based on a relationship between the fourth subpixel signal and the any fourth stimulus value signal of the fourth subpixel signal, assigning the minimum value to the any fourth stimulus value signal, to obtain the fourth subpixel signal.

8. The non-transitory computer-readable storage medium according to claim 7, wherein:

the fourth stimulus value signal is a stimulus value signal WX, a stimulus value signal WY, or a stimulus value signal WZ; and the any fourth stimulus value signal is the stimulus value signal WY.

9. The non-transitory computer-readable storage medium according to claim 6, wherein the set of stimulus value signals comprises the stimulus value signal RY, the stimulus value signal GY, and the stimulus value signal BY.

10. The non-transitory computer-readable storage medium according to claim 6, wherein the set of stimulus value signals comprises the stimulus value signal RX, the stimulus value signal GY, and the stimulus value signal BZ.

11. A computer device, comprising a memory and a processor, the memory storing a computer program, and when executing the computer program, the processor performing the following steps:

obtaining a pixel signal, wherein the pixel signal comprises an initial first subpixel signal, an initial second subpixel signal, and an initial third subpixel signal, and the pixel signal is configured to correspondingly drive a subpixel R, a subpixel G, and a subpixel B in a specific pixel unit;

obtaining first stimulus value signals of the initial first subpixel signal based on the initial $$\begin{cases} RX = (R/T)^{\wedge\gamma RX} \\ RY = (R/T)^{\wedge\gamma RY} \\ RZ = (R/T)^{\wedge\gamma RZ} \end{cases},$$

first subpixel signal by a first formula of wherein the first stimulus value signals are at least one of a stimulus value signal RX, a stimulus value signal RY, or a stimulus value signal RZ;

obtaining second stimulus value signals of the initial second subpixel signal based on the $$\begin{cases} GX = (G/T)^{\wedge\gamma GX} \\ GY = (G/T)^{\wedge\gamma GY} \\ GZ = (G/T)^{\wedge\gamma GZ} \end{cases},$$

initial second subpixel signal by a second formula of wherein the second stimulus value signals are at least one of a stimulus value signal GX, a stimulus value signal GY, or a stimulus value signal GZ;

obtaining third stimulus value signals of the initial third subpixel signal based on the $$\begin{cases} BX = (B/T)^{\wedge\gamma BX} \\ BY = (B/T)^{\wedge\gamma BY} \\ BZ = (B/T)^{\wedge\gamma BZ} \end{cases},$$

initial third subpixel signal by a third formula of wherein the third stimulus value signals are at least one of a stimulus value signal BX, a stimulus value signal BY, or a stimulus value signal BZ;

obtaining a fourth subpixel signal based on a minimum value in a set of stimulus value signals, wherein the set of stimulus value signals comprises a first stimulus value signal of the first stimulus value signals, a second stimulus value signal of the second stimulus value signals, and a third stimulus value signal of the third stimulus value signals; and using the initial first subpixel signal, the initial second subpixel signal, the initial third subpixel signal, and the fourth subpixel signal as converted pixel signals, wherein the converted pixel signals are configured to correspondingly drive the subpixel R, the subpixel G, the subpixel B, and a subpixel W in the specific pixel unit, wherein:

RX is the stimulus value signal RX, RY is the stimulus value signal RY, RZ is the stimulus value signal RZ, and R is the initial first subpixel signal;

GX is the stimulus value signal GX, GY is the stimulus value signal GY, GZ is the stimulus value signal GZ, and G is the initial second subpixel signal;

BX is the stimulus value signal BX, BY is the stimulus value signal BY, BZ is the stimulus value signal BZ, and B is the initial third subpixel signal;

T is a maximum pixel signal value;

γRX, γRY, and γRZ are all stimulus value power functions of the initial first subpixel signal;

γGX, γGY, and γGZ are all stimulus value power functions of the initial second subpixel signal; and γBX, γBY and γBZ are all stimulus value power functions of the initial third subpixel signal.

12. The computer device according to claim 11, wherein a process of obtaining a fourth subpixel signal based on a minimum value in a set of stimulus value signals comprises the following step:

assigning any fourth stimulus value signal to the minimum value, based on a relationship between the fourth subpixel signal and the any fourth stimulus value signal of the fourth subpixel signal, assigning the minimum value to the any fourth stimulus value signal, to obtain the fourth subpixel signal.

13. The computer device according to claim 11, wherein the fourth stimulus value signal is a stimulus value signal WX, a stimulus value signal WY, or a stimulus value signal WZ; and the any fourth stimulus value signal is the stimulus value signal WY.

14. The computer device according to claim 11, wherein the set of stimulus value signals comprises the stimulus value signal RY, the stimulus value signal GY, and the stimulus value signal BY.

15. The computer device according to claim 11, wherein the set of stimulus value signal set comprises the stimulus value signal RX, the stimulus value signal GY, and the stimulus value signal BZ.

* * * * *